US005085744A

United States Patent [19]

Brasch

[11] Patent Number: 5,085,744

[45] Date of Patent: Feb. 4, 1992

[54] ELECTROPLATED GOLD-COPPER-ZINC ALLOYS

[75] Inventor: William R. Brasch, Nesconset, N.Y.

[73] Assignee: LeaRonal, Inc., Freeport, N.Y.

[21] Appl. No.: 609,671

[22] Filed: Nov. 6, 1990

[51] Int. Cl.[5] ..... C25D 3/56; C25D 3/62; C25D 3/58

[52] U.S. Cl. ..... 205/148; 205/266; 205/268

[58] Field of Search ..... 204/44, 44.2, 44.3

[56] References Cited

U.S. PATENT DOCUMENTS

| | | | |
|---|---|---|---|
| 3,672,969 | 6/1972 | Nobel et al. | 204/44.3 |
| 3,915,814 | 10/1975 | Greenspan | 204/40 |
| 4,358,351 | 11/1982 | Simon et al. | 204/44 |
| 4,366,035 | 12/1982 | Wilkinson | 204/44 |
| 4,980,035 | 12/1990 | Emmenegger | 204/44 |

FOREIGN PATENT DOCUMENTS

| | | | |
|---|---|---|---|
| 304315 | 2/1989 | European Pat. Off. . | |
| 3020765 | 12/1981 | Fed. Rep. of Germany . | |
| 3345794 | 7/1985 | Fed. Rep. of Germany | 204/44 |
| 3345795 | 7/1985 | Fed. Rep. of Germany . | |
| 3601559 | 7/1987 | Fed. Rep. of Germany . | |
| 3633529 | 5/1988 | Fed. Rep. of Germany . | |
| 2151661 | 7/1985 | United Kingdom . | |
| 2195660 | 4/1988 | United Kingdom . | |

OTHER PUBLICATIONS

Japanese Abstract 57-5886, "Gold Alloy Plating Bath", Togawa (1/82).

*Primary Examiner*—John Niebling
*Assistant Examiner*—Steven P. Marquis
*Attorney, Agent, or Firm*—Pennie & Edmonds

[57] ABSTRACT

A solution for electroplating gold-copper-zinc alloys. A solution containing excess cyanide and hydroxide ions, gold and copper each in the form of a cyanide complex, and zinc at least partially in the form of a zincate complex. Additives such as conductivity salts, chelating agents, surfactants or wetting agents, brightening agents, and reducing agents may also be present to impart a particular feature or characteristic to the solution. Also, a process for electroplating up to about 20 microns of a gold-copper-zinc alloy upon a substrate using these novel solutions. The alloy is deposited upon a substrate which is immersed in the solution by electroplating at a current density of between about 1 and 15 ASF (0.1 to 1.5 ASDM) at a temperature of about 60° and 120° F. for a sufficient time to obtain the desired thickness. Generally, thicknesses of 5 to 10 microns or more can be obtained without microcracking. Finally, method for increasing the ductility and corrosion resistance of the deposit by simply heating the deposit to about 50° to 200° C. in air for a time of about 2 to 24 hours.

42 Claims, No Drawings

ELECTROPLATED GOLD-COPPER-ZINC ALLOYS

TECHNICAL FIELD

The invention relates to the electrodeposition of gold-copper-zinc alloys, and more particularly to their application of such deposited alloys as or upon jewelry components for decorative use.

BACKGROUND OF THE INVENTION

Gold alloys have been deposited for many years onto watchcases, watchbands, eyeglass frames, writing instruments, costume jewelry, and the like. The karat of these deposits usually ranges from 12 to 18, the deposit thicknesses range from 2 to 20 microns, and the deposit colors are pale yellow to pink. For many years, the most successful electroplated gold alloy for these applications has been gold-copper-cadmium. Since cadmium is such a poisonous metal, the industry has been searching for a substitute for cadmium which does not have its toxicity. In addition to being non-toxic, the gold alloy deposits produced with this cadmium substitute must have the required physical characteristics, as follows:

1. The deposits must have the correct color, as required. Usually, these colors are the Swiss standard "1–5N," which range from specific pale yellow to pink gold alloys with the "2N" yellow grade being preferred.

2. The deposits must be bright so that no further polishing is required after plating. This degree of brightness must be maintained even for thick deposits as high as 20 microns.

3. The plating bath must produce deposits that exhibit levelling such that tiny imperfections in the basis metal are smoothed out or covered.

4. The karat of the deposits should be as required. These karats generally range from about 12 to 18, or about 50–75% gold.

5. All deposits must be reasonably ductile and capable of passing the required ductility tests, even with thicknesses as high as 20 microns.

6. The deposits should be corrosion resistant and capable of passing the required corrosion tests.

Attempts have been made in the past to deposit gold-copper-zinc alloys as a substitute for the conventional gold-copper-cadmium alloys. For example, European Patent Application 03 04 315 Al discloses a process for depositing gold-copper-zinc alloys where each of the three metals is present in the plating bath as the cyanide complex. Bismuth and tellurium are additives disclosed for improved corrosion resistance of the deposits. Nothing is mentioned in the disclosure or the examples about thick deposits with respect to brightness or ductility or the ability to produce deposits free of cracks. The invention stresses improved corrosion resistance.

The German Offenlegungsschrift No. DE 36 33 529 A1 plates gold-copper-zinc alloys from plating baths in which the gold is present as a cyanide complex, zinc is present as the zinc chelate, and the plating bath is free from zinc cyanide complexes. The disclosure states in column 2, lines 22–25 that thicker deposits are brittle, cracked, and can exfoliate; which indicates that this bath is only suitable for electroplating thin deposits.

German Offenlegungsschrift No. DE 33 45 795 A discloses gold-copper-zinc electrodeposits from solutions that contain gold and copper as their alkali cyanide complexes, with zinc present as an alkali zinc chelate. The alkali metal is sodium instead of potassium. Deposits are bright but there is no discussion of brittleness in thicker deposits, and the deposit thickness in the example is relatively thin.

German Offenlegungsschrift No. DE 36 01 559 A discloses gold-copper-zinc electrodeposits from solutions that contain gold and copper as their alkali cyanide complexes and/or as an alkali zinc chelate. There is no discussion of brightness or brittleness in thick deposits.

German Offenlegungsschrift No. DE 30 20 765 A1 discloses copper-gold-zinc alloys in which all three metals are present in the plating bath as their cyanide complexes. The baths also must contain potassium carbonate or bicarbonate as additives. Although the disclosure states that deposits are ductile, no deposit thicknesses are stated.

None of the above disclosures have resulted in a commercially acceptable plating bath. None of them have been shown to be capable of producing deposits with the required characteristics given above. In all the above disclosures, attempts to produce gold-copper-zinc deposits by following the examples of these references were unsuccessful in that the resultant deposits were very brittle in the thickness range of 10 to 20 microns. In addition, most deposits exhibited spontaneous cracking or exfoliation, and brightness and levelling characteristics were far inferior to current industry requirements.

SUMMARY OF THE INVENTION

The present invention relates to a solution for electroplating gold-copper-zinc alloys. The solution contains excess cyanide and hydroxide ions, gold and copper each in the form of a cyanide complex, and zinc at least partially in the form of a zincate complex. Additives such as conductivity salts, chelating agents, surfactants or wetting agents, brightening agents, and reducing agents may also be present to impart a particular feature or characteristic to the solution.

Another aspect of the invention relates to a process for electroplating up to about 20 microns of a gold-copper-zinc alloy upon a substrate using these novel solutions. The alloy is deposited upon a substrate which is immersed in the solution by electroplating at a current density of between about 1 and 15 ASF (0.1 to 1.5 ASDM) at a temperature of about 60° and 120° F. for a sufficient time to obtain the desired thickness. Generally, thicknesses of 5 to 10 microns or more can be obtained without micro-cracking.

The invention also relates to methods for increasing the ductility and corrosion resistance of the deposit by simply heating the deposit to a temperature of about 50° to 200° C. in air for about 2 to 24 hours.

DETAILED DESCRIPTION OF THE INVENTION

The present invention relates to gold-copper-zinc alloys deposited from a formulation that is new and different from the prior art, and for the first time, deposits can be produced that meet all of the required characteristics listed above. In this invention, gold is present in the plating bath as its cyanide complex, copper is also present as the cyanide complex; but, unlike the prior art, zinc is present at least partially or completely as a zincate complex. The bath also contains some free cyanide, free alkali hydroxide and, optionally, a chelating agent for zinc. The electrolyte can also optionally contain conductivity salts and the alkali metal ions present can be potassium, sodium, or mixtures thereof. The plating bath can also contain a wetting agent to reduce surface tension and eliminate pitting in the deposits. As a brightening agent, the plating bath can contain a trace amount of a dissolved antimony compound.

The free cyanide ions, free hydroxyl ions and optional chelating agent ions, all compete to form their corresponding complexes with zinc in the plating bath. The degree to which zinc will form its complex or chelate with the various ions in the bath depends upon a number of factors such as: (a) the stability constants of zinc complexes with cyanide, hydroxide, and the particular chelating agent under plating conditions, (b) the concentrations of these and other bath constituents, and (c) the bath temperature and other plating parameters. Zinc can therefore theoretically be present in the electrolyte partially as its cyanide complex, partially as its hydroxide or zincate complex, and partially as its chelate complex if a chelating agent is used. It is believed that the zincate complex predominates in the preferred solution since a relatively high concentration of free alkali hydroxide is maintained therein. Thus, the preferred amount of free alkali hydroxide is that which will maintain zinc substantially as the zincate complex. The alkali hydroxide can be either sodium or potassium hydroxide and the useful amounts may range from 2 to 60 g/l with 10 to 30 g/l being preferred. Thus, the pH of the solution should be at least about 11, preferably 12 or above.

Gold can be added to the plating bath in any form, either monovalent or trivalent, as long as it will form a cyanide complex in the presence of an excess of alkali cyanide. The concentration of gold metal in the plating bath can vary from 0.2 to 10 grams per liter, and preferably 0.75 to 1.5 grams per liter. Lower concentrations of gold are preferable since there is less drag-out, the deposits tend to be less brittle, and bath makeup costs are lower.

Copper is generally added as a cyanide salt which forms a bath soluble alkali copper-cyanide complex in the presence of free alkali cyanide. The copper concentration depends upon the required karat and color of the deposits, with higher copper concentrations favoring rose colors and lower karats. Metallic copper concentrations in the plating bath can range from 1 to 25 grams per liter, with 3 to 10 grams per liter being preferred.

Zinc can be added as an alkali zincate, zinc cyanide, zinc chelate, or any soluble zinc compound capable of forming the soluble alkali zincate complex in the presence of free alkali hydroxide. The concentration of zinc in the plating bath also assists in the control of deposit color, with higher concentrations favoring yellow deposits with slightly lower karats. The concentration of zinc can vary from 0.05 to 2 grams per liter, with 0.1 to 0.25 grams per liter being preferred.

Alkali cyanide is added to the plating bath to form gold and copper complexes, and preferably as excess alkali cyanide, commonly known as free alkali cyanide. The concentration of free alkali cyanide in the plating bath can be as high as 10 grams per liter, with 1.5 to 4 grams per liter being preferred. Alkali cyanide can be added either as sodium or potassium cyanide.

Conductivity salts are optionally added to the bath to assist in carrying the plating current. The conductivity salts which are commonly used in the art, such as phosphates, carbonates, sulfates, tartrates, gluconates, and the like, are suitable. The concentration of this component can range from 0 to 60 grams per liter.

The bath can also optionally contain a surface active agent and those commonly used in the art for plating gold-copper-cadmium alloys can be used in the present invention. Examples of these surface active or wetting agents include alkylene oxide condensation compounds, such as ethoxylated fatty acid phosphates or phosphonates, fatty acid amine oxides, and derivatives or variations thereof. The surface active agent used should be stable, compatible with the plating bath, and capable of reducing both the surface tension of the solution and the occurrence of pitting in the resultant plated deposits. The concentration of this component can range from 0.1 to 10 grams per liter or 0.1 to 5 milliliters per liter.

As a brightener, the bath should contain a minor amount of a soluble antimony compound, preferably one having the antimony in its trivalent ionic state. Soluble arsenic can also be used; however, the preferred brightener is antimony. Antimony can be added in any soluble form as long as it is compatible with the plating bath. A preferred compound is potassium antimony tartrate since it is readily available and relatively inexpensive. In order to stabilize the antimony in its preferred trivalent state, a reducing agent can optionally be added, such as sodium hypophosphite, or a hydroxylamine. The amount of soluble antimony in the solution to produce bright deposits can range from 0.5 to 10 ppm, with 1 to 3 ppm preferred.

The current density used in this process can range from 1 to 15 ASF, with 4 to 6 ASF preferred. Higher current densities tend to produce lower karat alloys with pinker colors and lower current densities will produce lower karats with yellower colors for any given plating bath. The plating time depends upon the deposit thickness required and the current density of plating, as well as the cathode efficiency.

Temperature of the plating bath can range from 60° to 120° F., with 90° to 110° F. preferred. As stated above, lower temperatures are preferred for improved ductility and brightness. Mild solution agitation or work movement should be provided for optimum results.

As stated above, prior art gold-copper-zinc alloy electrodeposits all suffered from brittleness, particularly when deposit thicknesses were high. When attempts were made to deposit about 1 or 2 microns by following the examples given in the cited references, spontaneous cracking of the deposits became evident. Deposit thicknesses above about 5 microns were severely cracked and some exfoliated from the base metal. In comparison, the deposits produced by following the teachings of the present invention are not cracked, even with thicknesses as high as 20 microns. Although these heavy deposits are not cracked as plated, they are somewhat brittle and will crack if they are subjected to excessive bending or flexing.

It has been known in the prior art that brittleness in electrodeposits can be overcome by heat treating the deposit at about 350°-500° C. for about 1-5 minutes in a reducing atmosphere. Surprisingly, however, it has now been found that electrodeposits produced by following the present teachings can be made significantly more ductile by treatment in a simple air oven at low temperatures with no special atmosphere. Improvement in the ductility of these deposits will take place at heating temperatures of 50°-200° C. with 120°-180° C. preferred. The time required in the air oven varies inversely with temperature and can range from 2–24 hours or longer if desired.

The present gold-copper-zinc alloys will pass the conventional nitric acid test even with karat values as low as 14 karat. It has now surprisingly been found that the degree to which these low karat deposits will pass this test is markedly improved by the low temperature heat treatments given above. A 14 karat deposit as plated will show a dark spot after it is subjected to nitric acid. After heat treating—even at low temperatures in an air oven—the ability of the same deposit to pass the nitric acid test is improved to such a degree that only a very slight discoloration is seen after the test. Thus, heat treatment can also be used to improve the corrosion resistance of the deposits of the invention.

EXAMPLES

References is now made to the following examples for a more detailed explanation of the preferred embodiments of the invention.

EXAMPLE 1

A plating bath of the following composition was prepared:

| | |
|---|---|
| 12.5 g/l | NaCN |
| 7 g/l | Copper as CuCN |
| 20 g/l | NaOH |
| 0.15 g/l | Zinc as $ZnSC_4.H_2O$ |
| 0.75 g/l | Pyridine Dicarboxylic Acid |
| 5 g/l | Disodium Tartaric Acid |
| 0.5 g/l | Sodium Hypophosphite |
| 2 ppm | Antimony as Potassium Antimonyl Tartrate |
| 1 g/l | Gold as $KAU(CN)_2$ |
| 0.5 ml/l | Amine Oxide Wetting Agent |
| balance | Water |

Brass and stainless steel watch cases were plated in the above bath at 5 ASF (0.5 ASDM), for 60 minutes. The bath temperature was 100° F. (38° C.), and the agitation was supplied by motorized circular cathode movement and solution stirring.

The deposit was mirror bright, pale yellow in color, and showed no micro-cracking. The karat was 14 and the thickness was 10 microns.

EXAMPLE 2

The bath of Example 1 was prepared with the following changes:

| | |
|---|---|
| 8.2 g/l | NaCN |
| 5 g/l | Copper as CuCN |

The deposit again was mirror bright, yellow in color, and showed no micro-cracking. The karat was 16 and thickness was 10 microns.

EXAMPLE 3

The bath of Example 2 was prepared without the antimony brightening agent.

The deposit was not mirror bright but somewhat hazy in appearance. The hazy appearance slowly became apparent the longer the plating took place. For short plating times or thin deposits, the hazy appearance is not observed. The brightening effect with the antimony present in the bath was seen at thicknesses above 2 microns.

EXAMPLE 4 (COMPARATIVE)

The bath of Example 1 was prepared except that a gold concentration of 3 g/l was used.

The deposit was mirror bright, yellow in color, but exhibited micro-cracking. The cracking indicated poor ductility due to high internal stress in the deposit. The level of gold concentration in the bath and the effect on the ductility of the deposit is significant and is a surprising result. It is believed the gold concentration level in the bath influences the ductility by forming a deposit structure similar to the wrought alloy.

EXAMPLE 5 (COMPARATIVE)

A one liter bath as per Example 1 was prepared without the addition of NaOH. The zincate complex was not present. The pH of the solution was 10.4.

A polished steel panel plated at 5 ASF (0.5 ASDM) was overall dull-reddish in appearance. By analysis, only 0.2% zinc was found in the deposit.

EXAMPLE 6

The formation of zincate complex in situ was then made by the addition of the 20 g/l NaOH to the bath of Example 6, which raised the pH to above 12.

A polished steel panel was plated at 5 ASF (0.5 ASDM). The panel was mirror bright, pale yellow in color with 5% zinc in the deposit.

EXAMPLE 7

A one liter bath was made as above in Example 6 but without the chelating agents, pyridine dicarboxylic acid, and disodium tartrate. The tests were repeated and the results were similar to Example 6.

The above tests (Example 5, 6 and 7) clearly demonstrate the novelty and importance of the zincate complex of the invention.

EXAMPLE 8

Five polished brass panels were plated with the Example 2 bath to a thickness of 10 microns. Four of the panels were subjected to heat treatment as follows:

A 360° C. (680° F.) for 3 minutes in a reducing atmosphere furnace

B 121° C. (250° F.) for 2 hours in a conventional air oven

C 121° C. (250° F.) for 16 hours in a conventional air oven

D 121° C. (250° F.) for 24 hours in a conventional air oven

The panels after heat treatment were allowed to cool and then cut in half. The panel without the heat treatment was used as the control and was also cut in half.

The first half of the panels were then subjected to a ductility test by bending around a ¼ mandrel to 90°, and then examined for cracking under 20X magnification.

Cracking was noted in the bend area on the control panel. Panels A, C and D had no cracking, while panel B exhibited very slight cracking, although considerably less than the control panel.

The second half of the panels including the control panel were subjected to corrosion testing with nitric acid. Discoloration of alloy gold deposits by nitric acid is used widely throughout the industry as a fast test to measure corrosion resistance. A drop of nitric acid was placed on each of the panels for 10 seconds. Each panel was examined for discoloration in the area where the nitric acid was placed. The control panel without the heat treatment displayed discoloration. The heat treated panels all displayed no discoloration.

The response to improved ductility and corrosion resistance with low temperature heat treatment indicates the deposits are more like a true alloy and not just a mixture of metals.

EXAMPLE 9

Two brass watch cases were plated in the following bath formulation for 30 minutes at 5 ASF (0.5 ASDM).

| | |
|---|---|
| 11 g/l | NaCN |
| 1.5 g/l | KCN |
| 10 g/l | CuCN |
| 20 g/l | NaOH |
| 0.15 g/l | Zinc as $ZnSO_4.H_2O$ |
| 0.75 g/l | Pyridine Dicarboxylic Acid |
| 5 g/l | Disodium Tartaric Acid |
| 0.5 g/l | Sodium Hypophosphite |
| 2 ppm | Antimony as Potassium Antimonyl Tartrate |
| 1 g/l | Gold as $KAu(CN)_2$ |
| 0.5 ml/l | Amine Oxide Wetting Agent |

After plating, one case was heat treated at 175° C. for 24 hours, then allowed to cool to ambient temperature. The second case was not heat treated. The two cases were then placed in a beaker containing 25% nitric acid. After complete dissolution of the brass base metal, a shell of the heat treated sample deposit was formed. The non-heat treated sample deposit did not form a shell and instead was broken apart into small pieces.

The above test is performed widely in the industry to evaluate the protective value of low karat deposited coatings on watch cases and jewelry. Clearly, the above shows the surprising results obtainable by the low temperature heat treatment conducted on the deposit plated from a bath according to the invention.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A solution for electroplating a gold-copper-zinc alloy which comprises:

a source of cyanide ions a soluble gold compound present as a gold cyanide complex in the solution;

a soluble copper compound present forming a copper cyanide complex in the solution;

a soluble zinc compound capable of at least partially as a zincate complex in the solution; and a source of hydroxide ions in an amount sufficient to form a zincate complex with the zinc compound, said solution having a pH of at least about 11.

2. The solution of claim 1 wherein the concentration of gold ranges from about 0.2 to 10 g/l as gold metal.

3. The solution of claim 1 wherein the concentration of copper metal ranges from about 1 to 25 g/l as copper metal.

4. The solution of claim 1 wherein the source of hydroxide ions is an alkali hydroxide in a concentration of about 2 to 60 g/l and the pH of the solution is at least about 12.

5. The solution of claim 1 wherein the zinc compound is added as an alkali zincate, zinc cyanide or zinc sulfate.

6. The solution of claim 1 wherein the concentration of zinc ranges from about 0.05 to 2 g/l as zinc metal.

7. The solution of claim 1 wherein the source of cyanide ions is an alkali cyanide.

8. The solution of claim 7 wherein the alkali cyanide is sodium or potassium cyanide and is present in a concentration of up to 10 g/l as free alkali cyanide.

9. The solution of claim 1 further comprising chelating agent.

10. The solution of claim 9 wherein the chelating agent is pyridine dicarboxylate, an alkali tartrate, or mixtures thereof.

11. The solution of claim 1 further comprising a conductivity salt.

12. The solution of claim 11 wherein the conductivity salt is a phosphonate, carbonate, sulfate, tartrate or gluconate.

13. The solution of claim 11 wherein the conductivity salt is present in a concentration of up to 60 g/l.

14. The solution of claim 1 further comprising a wetting agent.

15. The solution of claim 14 wherein the wetting agent is an alkylene oxide condensation compound.

16. The solution of claim 14 wherein the wetting agent is a condensate of an alkoxylated fatty acid phosphate, an alkoxylated fatty acid phosphonate, or fatty acid amine oxide.

17. The solution of claim 14 wherein the wetting agent is present in a concentration of between about 0.1 and 10 g/l or between about 0.1 to 5 ml/l.

18. The solution of claim 1 further comprising a brightener.

19. The solution of claim 18 wherein the brightener is a soluble antimony compound.

20. The solution of claim 18 wherein the concentration of the brightener ranges from about 0.5 to 10 ppm as antimony metal.

21. The solution of claim 19 wherein the brightener is potassium antimony tartrate and is present at concentration ranging from about 1 to 3 ppm as antimony metal.

22. The solution of claim 19 further comprising a reducing agent for stabilizing the brightening agent.

23. The solution of claim 22 wherein the reducing agent is a hypophosphite or hydroxylamine compound.

24. The solution of claim 22 wherein the reducing agent is present in a concentration of between 0.1 to 2 g/l.

25. A solution for electroplating a gold-copper-zinc alloy which comprises:

an alkali cyanide compound in an amount sufficient to provide a source of cyanide ions for the solution up to about 10 g/l as free alkali cyanide;

a soluble gold compound present as of forming gold cyanide complex in the solution and being present at a concentration of between about 0.2 and 10 g/l as gold metal;

a soluble copper compound present as a copper cyanide complex in the solution and being present at a concentration of between about 1 and 25 g/l; as copper metal.

a soluble Zinc compound present at least partially as a zincate complex in the solution and being present at a concentration of between about 0.05 and 2 g/l; as zinc metal and an alkali hydroxide compound as a source of hydroxide ions to form the zincate complex and being present at a concentration of between about 2 and 60 g/l and the pH of the solution is at least about 12.

26. The solution of claim 25 wherein the gold is added as a monovalent or trivalent cyanide complex and is present at concentration of between about 0.75 and 1.5 g/l as gold metal.

27. The solution of claim 25 wherein the copper is added as an alkali copper cyanide complex and is present at a concentration of between about 3 and 10 g/l as copper metal.

28. The solution of claim 25 wherein the zinc is added as an alkali zincate, zinc cyanide or zinc sulfate and is present at a concentration of between about 0.1 and 0.25 g/l as zinc metal.

29. The solution of claim 25 wherein the alkali cyanide is sodium or potassium cyanide and is present at a concentration of between about 0.5 and 10 g/l as free cyanide.

30. The solution of claim 25 wherein the alkali hydroxide is present at a concentration of between about 10 and 30 g/l and the pH of the solution is at least about 12.

31. The solution of claim 25 further comprising a chelating agent.

32. The solution of claim 25 further comprising a conductivity salt.

33. The solution of claim 25 further comprising a wetting agent.

34. The solution of claim 25 further comprising a brightener.

35. The solution of claim 34 further comprising a reducing agent for stabilizing the brightening agent.

36. A process for electroplating up to about 20 microns of a gold-copper-zinc alloy which comprises:

formulating the solution of claim 1 or 25;

immersing a substrate at least partially into the solution; and electroplating a gold-copper-zinc alloy upon the substrate at a current density of between about 1 to 15 ASF and at a temperature of between about 60 ° and 120° F. for a sufficient time to deposit a desired thickness of the alloy.

37. The process of claim 36 which further comprises adding a brightener to the solution prior to immersing the substrate therein.

38. The process of claim 36 which further comprises agitating the solution or moving the work while electroplating to obtain optimum electroplating results.

39. The process of claim 36 wherein the temperature is between about 90° and 110° F.

40. The process of claim 36 wherein the current density is between about 4 to 6 ASF.

41. The process of claim 36 wherein the alloy is deposited to a thickness of between about 2 to 20 microns without cracking.

42. The process of claim 40 wherein the alloy is deposited to a thickness of above 5 microns.

* * * * *